US006068072A

United States Patent [19]

Besson et al.

[11] Patent Number: 6,068,072

[45] Date of Patent: May 30, 2000

[54] CUTTING ELEMENT

[75] Inventors: Alain Besson, Saint Rerny les Chevreuse, France; Gary Michael Thigpen, Houston; Coy M. Fielder, Cypress, both of Tex.

[73] Assignee: Diamond Products International, Inc., Houston, Tex.

[21] Appl. No.: 09/021,012

[22] Filed: Feb. 9, 1998

[51] Int. Cl.[7] ..... E21B 10/46

[52] U.S. Cl. ..... 175/432

[58] Field of Search ..... 175/428, 432, 175/329, 402.1

[56] References Cited

U.S. PATENT DOCUMENTS

| | | | |
|---|---|---|---|
| 280,541 | 7/1883 | Whitcomb . | |
| 280,543 | 7/1883 | Whitcomb . | |
| 755,930 | 3/1904 | Prentice . | |
| 1,081,131 | 12/1913 | Moore . | |
| 1,136,545 | 4/1915 | McDonald . | |
| 1,643,665 | 9/1927 | Lee . | |
| 2,030,374 | 2/1936 | Kless . | |
| 2,210,824 | 8/1940 | Walker, Sr. . | |
| 2,395,545 | 2/1946 | Genter . | |
| 2,702,698 | 2/1955 | Snyder et al. . | |
| 3,283,837 | 11/1966 | McKain . | |
| 3,995,707 | 12/1976 | Herke . | |
| 4,476,642 | 10/1984 | Hemphill . | |
| 4,838,729 | 6/1989 | Chennels . | |
| 4,861,350 | 8/1989 | Phaal et al. . | |
| 4,862,977 | 9/1989 | Barr et al. | 175/432 |
| 5,007,207 | 4/1991 | Phaal . | |
| 5,007,493 | 4/1991 | Coolidge et al. | 175/432 |
| 5,092,310 | 3/1992 | Walen et al. . | |
| 5,333,699 | 8/1994 | Thigpen et al. . | |
| 5,351,772 | 10/1994 | Smith . | |
| 5,355,969 | 10/1994 | Hardy et al. . | |
| 5,383,527 | 1/1995 | Azar | 175/432 |
| 5,484,330 | 1/1996 | Flood et al. . | |
| 5,486,137 | 1/1996 | Flood et al. . | |
| 5,494,477 | 2/1996 | Flood et al. . | |
| 5,499,688 | 3/1996 | Dennis . | |
| 5,505,273 | 4/1996 | Azar et al. | 175/432 |
| 5,524,719 | 6/1996 | Dennis . | |
| 5,544,713 | 8/1996 | Dennis . | |
| 5,566,779 | 10/1996 | Dennis . | |
| 5,590,728 | 1/1997 | Matthias et al. . | |
| 5,590,729 | 1/1997 | Cooley et al. . | |
| 5,601,477 | 2/1997 | Bunting et al. . | |
| 5,605,199 | 2/1997 | Newton . | |
| 5,617,928 | 4/1997 | Matthias et al. . | |
| 5,622,233 | 4/1997 | Griffin . | |
| 5,630,479 | 5/1997 | Dennis . | |
| 5,647,449 | 7/1997 | Dennis . | |
| 5,667,028 | 9/1997 | Truax et al. . | |
| 5,720,357 | 2/1998 | Fuller et al. | 175/432 |

FOREIGN PATENT DOCUMENTS

| | | | |
|---|---|---|---|
| 0322347 | 6/1989 | European Pat. Off. | 175/432 |

*Primary Examiner*—William Neuder
*Attorney, Agent, or Firm*—Snakey & Luck, L.L.P.

[57] ABSTRACT

A novel cutting element is disclosed as comprised of at an attachment body and a cutting face, where said attachment body is attached to said cutting face via a high temperature braze joint, the attachment body defining a projection and a grooved area, where said grooved area is disposed between the projection and the cutting face, the resultant cutting element providing both enhanced wear characteristics and stability.

21 Claims, 3 Drawing Sheets

FIG. 3
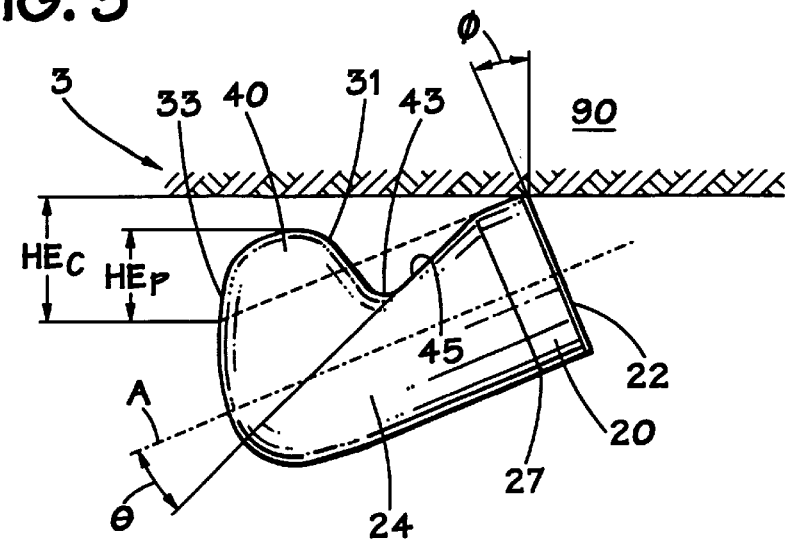
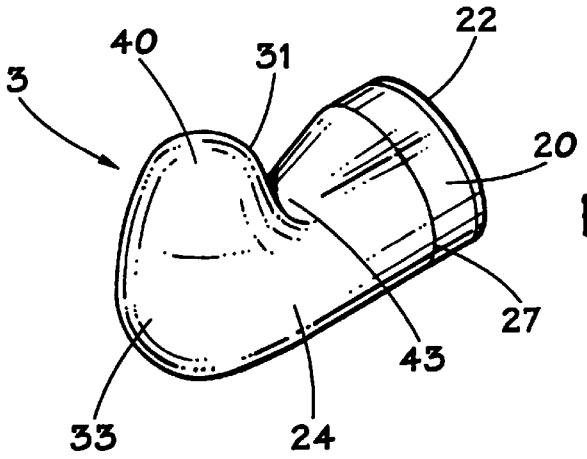
FIG. 4
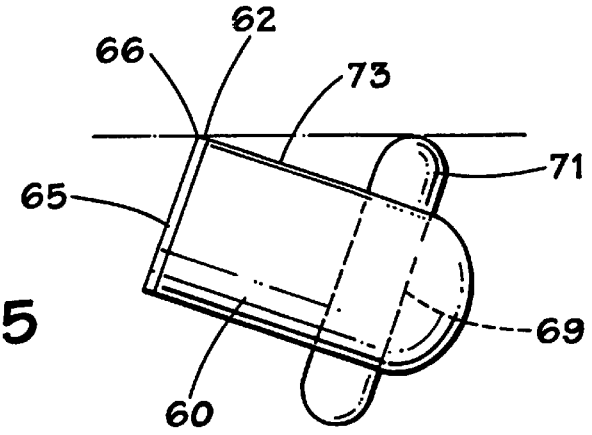
FIG. 5

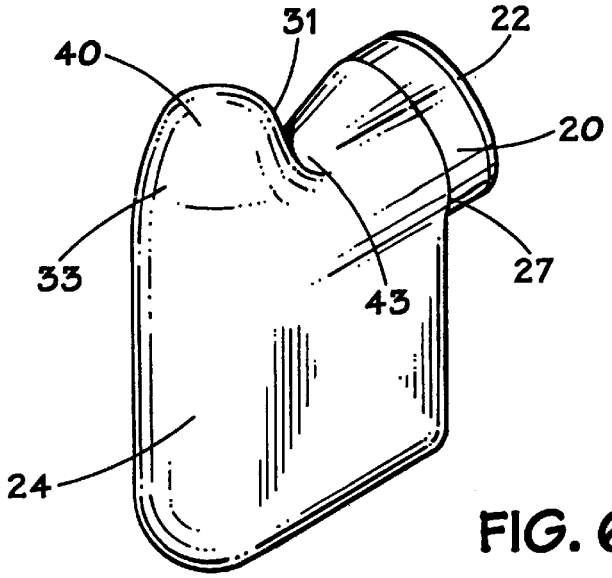
FIG. 6
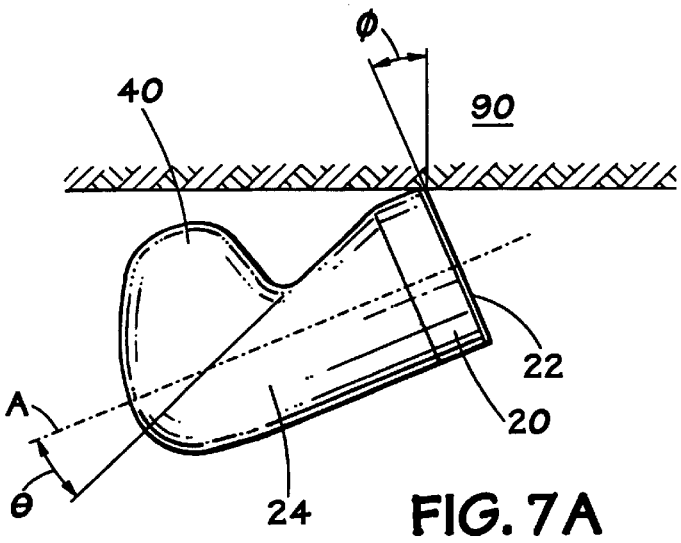
FIG. 7A
FIG. 7B
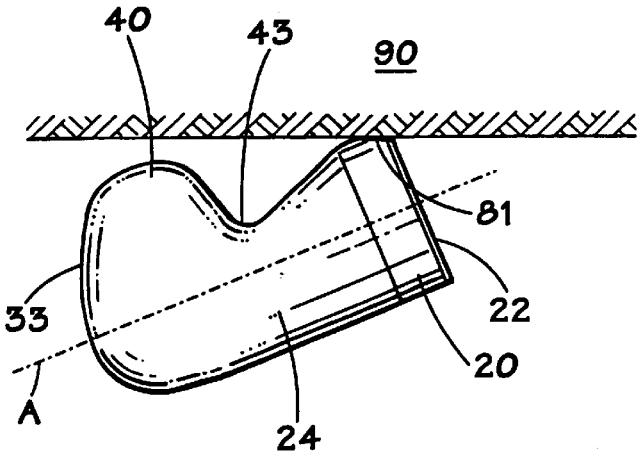

CUTTING ELEMENT

BACKGROUND OF THE INVENTION

1. Field of the Invention

The present invention generally relates to cutting elements for subterranean drill bits. More specifically, the present invention is directed to a novel cutting element which both serves to stabilize the bit as well as enhance bit wear life.

2. Description of the Prior Art

Diamond cutters have traditionally been employed as the cutting or wear portions of drilling and boring tools. Known applications for such cutters include the mining, construction, oil and gas exploration and oil and gas production industries. An important category of tools employing diamond cutters are those drill bits of the type used to drill oil and gas wells.

The drilling industry classifies commercially available drill bits as either roller bits or diamond bits. Roller bits are those which employ steel teeth or tungsten carbide inserts. As the name implies, diamond bits utilize either natural or synthetic diamonds on their cutting surfaces. A "fixed cutter", as that term is used both herein and in the oil and gas industries, describes drill bits that do not employ a cutting structure with moving parts, e.g. a rolling cone bit.

The International Association of Drilling Contractors (IADC) Drill Bit Subcommittee has officially adopted standardized fixed terminology for the various categories of cutters. The fixed cutter categories identified by IADC include polycrystalline diamond compact (pdc), thermally stable polycrystalline(tsp), natural diamond and an "other" category. Fixed cutter bits falling into the IADC "other" category do not employ a diamond material as any kind as a cutter. Commonly, the material substituted for diamond includes tungsten carbide. Throughout the following discussion, references made to "diamond" include pdc, tsp, natural diamond and other cutter materials such as tungsten carbide.

An oil field diamond bit typically includes a shank portion with a threaded connection for mating with a drilling motor or a drill string. This shank portion can include a pair of wrench flats, commonly referred to a "breaker slots", used to apply the appropriate torque to properly make-up the threaded shank. In a typical application, the distal end of the drill bit is radially enlarged to form a drilling head. The face of the drilling head is generally round, but may also define a convex spherical surface, a planar surface, a spherical concave segment or a conical surface. In any of the applications, the body includes a central bore open to the interior of the drill string. This central bore communicates with several fluid openings in the bit used to circulate fluids to the bit face. In contemporary embodiments, nozzles situated in each fluid opening control the flow of drilling fluid to the drill bit.

The drilling head is typically made from a steel or a cast "matrix" provided with polycrystalline diamond cutters. Prior art steel bodied bits are machined from steel and typically have cutters that are press-fit or brazed into pockets provided in the bit face. Steel head bits are conventionally manufactured by machining steel to a desired geometry from a steel bar, casting, or forging. The cutter pockets and nozzle bores in the steel head are obtained through a series of standard turning and milling operations. Cutters are typically mounted on the bit by brazing them directly into a pocket. Alternatively, the cutters are brazed to a mounting system and pressed into a stud hole, or, still alternatively, brazed into a mating pocket.

Matrix head bits are conventionally manufactured by casting the matrix material in a mold around a steel core. This mold is configured to give a bit of the desired shape and is typically fabricated from graphite by machining a negative of the desired bit profile. Cutter pockets are then milled into the interior of the mold to proper contours and dressed to define the position and angle of the cutters. The internal fluid passageways in the bit are formed by positioning a temporary displacement material within the interior of the mold which is subsequently removed. A steel core is then inserted into the interior of the mold to act as a ductile center to which the matrix materials adhere during the cooling stage. The tungsten carbide powders, binders and flux are then added to the mold around the steel core. Such matrices can, for example, be formed of a copper-nickel alloy containing powdered tungsten carbide. Matrices of this type are commercially available to the drilling industry from, for example, Kennametal, Inc.

After firing the mold assembly in a furnace, the bit is removed from the mold after which time the cutters are mounted on the bit face in the preformed pockets. The cutters are typically formed from polycrystalline diamond compact (pdc) or thermally stable polycrystalline (tsp) diamond. PDC cutters are brazed within an opening provided in the matrix backing while tsp cutters are cast within pockets provided in the matrix backing.

Cutters used in the above categories of drill bits are available from several commercial sources and are generally formed by sintering a polycrystalline diamond layer to a tungsten carbide substrate. Such cutters are commercially available to the drilling industry from General Electric Company under the "STRATAPAX" trademark. Commercially available cutters are typically cylindrical and define planar cutting faces.

There are three basic styles of prior art cutter mounting systems. A first style is a polycrystalline diamond compact with a tungsten carbide stud pressed into a hole in the bit face where the pdc is brazed to a the stud. The stud is typically available in a variety of styles including "flat top" and "round top" configurations. The assembly of stud and pdc is force fitted into a hole in a steel bit face.

A second style of mounting system is a brazed attachment of the cutter into a pocket in a tungsten carbide matrix. In this style, a backing is formed of a tungsten carbide matrix where the geometry of the backing is controlled by the shape of the mold. In a third style, a high temperature braze joint is made between the pdc and a tungsten carbide carrier. In this prior art style, the assembly is brazed into a mating pocket with low temperature braze joint.

The pdc carrier typically features a solid blocky mass positioned behind the cutter without the presence of any void areas. Likewise, in the mechanical or brazed attachment system a solid blocky mass of cast tungsten carbide is utilized behind the cutter to provide sufficient mechanical strength. This mass is positioned with one flat side against the back of the cutter with the second flat side positioned toward the bit face. This configuration causes the rounded edge to become the exposed top rear of the pocket mass.

The forward or cutting portion of each cutter mounting system is designed to provide sufficient cutter attachment and retention. The rearward or attachment portion of each system behind the cutter must provide mechanical strength sufficient to withstand the forces exerted during the drilling operation. An essential requirement of any style is that the rearward portion of the mounting system not unduly flex, break or erode.

The cutting action in prior art bits is primarily performed by the outer semi-circular portion of the cutters. As the drill bit is rotated and downwardly advanced by the drill string, the cutting edges of the cutters will cut a helical groove of a generally semicircular cross-sectional configuration into the face of the formation. When drilling well bores in subsurface formations it often happens that the drill bit passes readily through a comparatively soft formation and strikes a significantly harder formation. In such an instance, rarely do all of the cutters on a conventional drill bit strike this harder formation at the same time. A substantial impact force is therefore incurred by the one or two cutters that initially strike the harder formation. The end result is high impact load on the cutters of the drill bit. Moreover, substantial wear or even destruction of the cutters initially striking the harder formation lessens the drill bit life.

Prior art drill bits also prone to premature wear as a result of vibration. This problem is particularly acute when the well bore is drilled at a substantial angle to the vertical, such as in the recently popular horizontal drilling practice. In these instances, the drill bit and the adjacent drill string are subjected to the downward force of gravity and a sporadic weight on bit. These conditions produce unbalanced loading of the cutting structure, resulting in radial vibration.

Prior investigations of the effects of the vibration on a drilling bit have developed the phraseology "bit whirl" to describe this phenomena.

A number of disadvantages are associated with conventional cutter mounting systems. First, as the cutter wears the bearing area of the bit face on the hole bottom substantially increases. This causes an increasing amount of heat to be created, which is then conducted through the cutter mounting system. Such excessive heat is detrimental to pdc cutters.

Second, the progressively increasing wear flat area decreases product performance. Termination of the bit run occurs due to excessive torque, excessive bit weight requirements, poor penetration rate, or poor cutter retention.

Third, because of the wear characteristics and associated limitations of prior art cutter mounting systems, used bits are frequently returned from the field with greater than 50% of the original diamond material remaining on the bit. Such waste unnecessarily enhances operating costs.

Finally, prior art cutter systems have no method for damping vibration experienced as a result of drilling conditions. Such bit vibration causes cutter breakage, excessive drill string torque, and consequently, less economical drilling operations.

SUMMARY OF THE INVENTION

The present invention is directed to an improved cutting element which addresses the above and other disadvantages associated with prior art mounting systems.

The cutting element of the present invention in a preferred embodiment employs a PDC cutting surface brazed onto a shaped mounting structure. Behind the cutting edge, the cutter defines at least one depression or void area and a stabilizing projection.

In a preferred embodiment, the void area is positioned behind the cutter and braze joint and generally parallel to the planar cutting face defined by the cutting surface. As a result of this void area, the cutter mounting system possesses a minimum surface area to drag on the hole bottom as the cutter wears, which minimum area translating into less frictional heating. The void area also serves as a passage for the thru flow of cooling fluid to remove generated heat during the drilling operation.

The stabilizing projection contacts the formation in the event of excessive formation penetration by the cutter. This projection also provides substantial resistance against lateral vibration or displacement of the drill bit.

The cutting element of the present invention offers a number of advantages over the art. One such advantage is the reduction of cutter temperature by the generation of less heat during use and the quick removal of any remaining heat via convective heat transfer.

Another advantage offered by the present invention is seen in the weight and torque reduction on the bit. By providing a selectively shaped and positioned void area in the mounting body, the present cutter mounting system retards and effectively minimizes the increase in bearing area. Moreover, with the reduced bearing area, friction between the cutting element and the formation is thereby reduced. With reduced bearing area, the weight on bit required to penetrate the formation is also reduced.

Yet another advantage offered by the invention is the reduction in size of the cutter wear flat area. A smaller wear flat area allows a lighter weigh on the bit with an equivalent depth of cut. A smaller wear flat area generates less heat from friction.

Other objects and advantages of the invention will become apparent from the following drawings and detailed description of the preferred embodiment.

BRIEF DESCRIPTION OF THE DRAWINGS

FIG. 3 illustrates a side, detailed view of a preferred embodiment of a cutter system of the present invention;

FIG. 4 illustrates a perspective view of the cutting system of FIG. 3;

FIG. 5 illustrates a side, detail view of the cutting system of FIG. 3; and FIG. 6 illustrates a detail, perspective view of a second embodiment of a stud mounted element of the present invention;

FIGS. 7A–7B illustrate a side schematic view of one embodiment of the cutting system of the present invention vis-a-vis the formation.

DETAILED DESCRIPTION OF THE PREFERRED EMBODIMENT

The present invention comprises an improved cutter system to dampen drill bit vibration and decrease the wear rate of the cutters.

Figure 2:
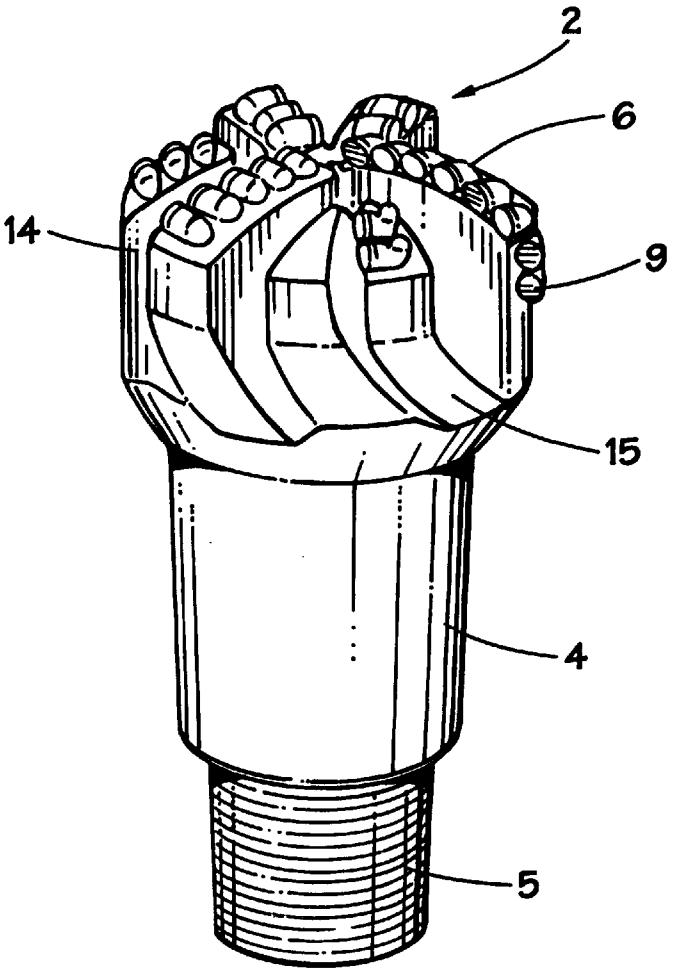
FIG. 2 illustrates a perspective view of the drill bit of FIG. 1.
Figure 1:
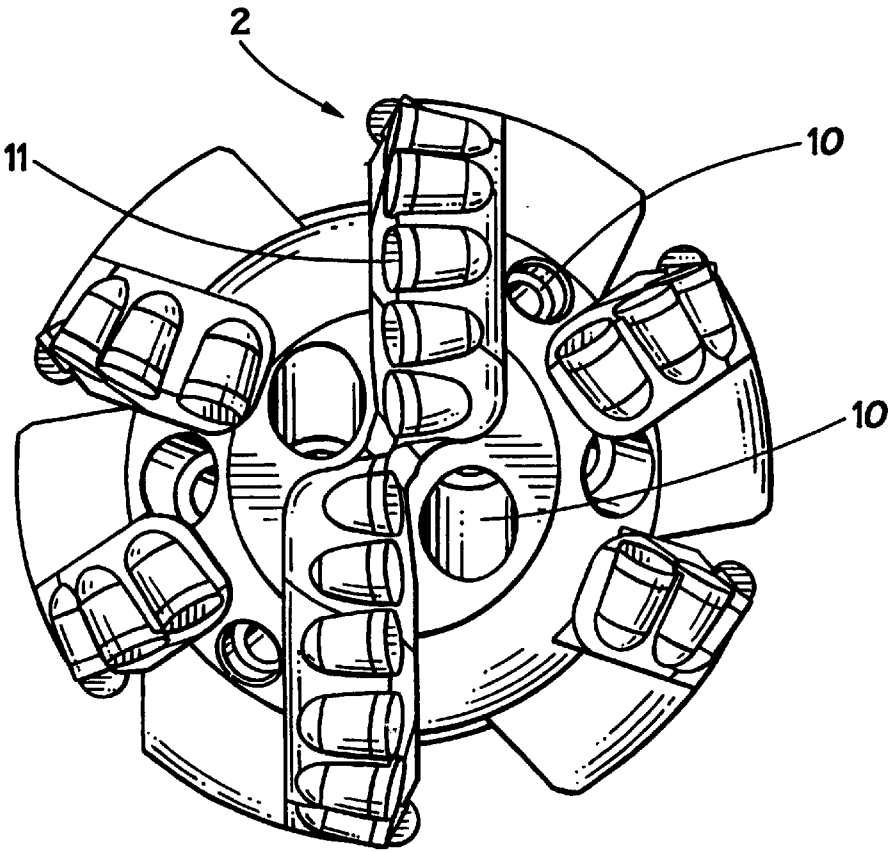
FIG. 1 illustrates a top view of a drill bit embodying the novel cutting elements of the present invention.

By reference to FIGS. 1 and 2, an exemplary drill bit 2 comprises at one end a shank 4 and a pin end 5 for connection to a drill string (not shown), where said bit 2 at its opposite end defines a bit face 6. In the illustrated embodiment, bit face 6 possesses a substantially spherical segment configuration. It is contemplated, however, that face 6 may possess either a convex or concave surface, or may alternately define a radial or conical surface.

Bit face 6 defines several bores 10 to enable the supply of drilling mud to the cutters 11. In a preferred embodiment, drill bit 2 is provided with gauging or reaming cutters 9 on its side wall 14. Typical reaming cutters 9 are angularly spaced, vertically aligned rows of PDC cutters provided on each blade of bit 2. As illustrated, gauge pads 15 may also be situated on drill bit 2 for purposes of stability.

The cutter mounting system of the present invention may be utilized in association with either of cutters 9 or 11. By reference to FIGS. 3–5, the cutter mounting system 3 of the present invention is defined by a carrier element 20 bonded to a mounting body 24, the combination defining a main, longitudinal axis "A". Body 24 is preferably comprised of tungsten carbide or other material demonstrating high wear characteristics, e.g. a high grade steel. In a preferred embodiment, the leading face 22 of carrier element 20 is comprised of a relatively thin layer of super hard material, e.g. a polycrystalline diamond material. It is contemplated this layer will be some 0.020–0.060" in thickness. Face 22 preferably is formed integrally with element 20 by way of a high temperature, high pressure sintering process as is well known to those skilled in the art. In the embodiment illustrated in FIGS. 3–5, cutting face 22 defines a planar configuration, although other non-planar cutting face geometries are also contemplated within the spirit of the present invention.

In the illustrated embodiment, carrier element 20 is secured to mounting body 24 via a high temperature braze joint 27. The method and apparatus for such brazing is disclosed in U.S. Pat. Nos. 4,225,322 and 4,319,707. Mounting body 24 is preferably comprised of tungsten carbide or other hard material, e.g. steel, and defines a leading face 31 and a trailing face 33 (See FIG. 4). Rounded leading face 31 and trailing face 33 are preferably integrally formed with the cutter mounting body 24, but may in an alternate embodiment be sintered onto body 24. Faces 31 and 33 are preferably comprised of a cemented tungsten carbide or other hard material.

By reference to FIGS. 3, 4, and 6, body 24 is provided with a stabilizing projection 40 positioned anterior to and defining a depression or void area 43 when viewed in the direction of travel of bit face 6. Although void area 43 is illustrated in these figures as situated generally along axis "A", in some applications void area 43 may be situated at an oblique angle.

In the bit 2 illustrated in FIGS. 4–7, mounting body 24 defines a forward wall 45 which is disposed at a relief angle $\theta$ in the range of 10–30 degrees, where $\theta$ is measured from axis "A". A lesser relief angle is desirable for use in softer formations. Higher relief angles, e.g. in excess of 20 degrees, are typically used in harder formations where the less aggressive angle results in lower stress on the cutting elements.

As illustrated, void area 43 separates carrier element 20 from stabilizing projection 40. The point of intersection of void area 43 with stabilizing projection 40 defines a rounded angle 39 which preferably forms a smooth, continuous transition from said area 43 to said projection 40. This transition area serves to lessen stress concentrations at that point in body 24. In such a fashion, the potential for stabilizing projection 40 to be broken or chipped during the drilling process is minimized.

Void area 43 serves a number of functions. One such function is to enhance the wear life of the carrier element 20 by serving as a passageway for the flow of drilling mud to remove heat generated during the drilling operation. Another function is to reduce the size of the cutter wear flat as the bit wears. With a smaller wear flat the bearing area of the bit is reduced, allowing a lighter weight on bit with an equivalent depth of cut. A smaller wear flat also generates less heat from friction.

In a preferred embodiment, stabilizing projection 40 defines a rounded shape and is disposed behind and aligned with cutter face 22 so that it will track in the groove cut by face 22. Projection 40 is preferably provided with external surfaces which have the same or similar cross-sectional configuration as cutting face 22. This rounded shape is desired because it will not cut into the formation.

By reference to FIGS. 3 and 7, the exposure height $HE_P$ of each stabilizing projection 40, relative to formation 90, is preferably less than the exposure height of $HE_C$ of cutting face 22. The preferred result is that the cutter face 22 of cutter 3 remains in constant engagement with formation 90, thereby reducing the tendency for excessive penetration. Moreover, stabilizing projection 40 resists and absorbs impacts with the formation caused by bit vibration and thereby significantly reduces drill bit vibration.

The cutter mounting system of the present invention is typically positioned at a slight back rake angle $\phi$, e.g. 10–30 degrees, relative to the formation when affixed to bit 2. (See FIG. 4) This back rake angle $\phi$ is measured from a line normal to be plane defined by formation 90 and the plane defined by face 22.

By reference to FIG. 7, normal drilling produces a cutter wear flat area 81 defined by a transverse section drawn through mounting body 24. As drilling progresses, cutter body 24 wears away, gradually reaching ever larger cross-sections. Progressive wear also increases the bearing area. The increased bearing area requires an increased weight on bit to achieve the same depth of cut. Increased weight on bit causes additional flexure in the drill string, resulting in high drill string stress and increased tendency to drill to the side. An increased bearing area increases the frictional heat generated, decreasing bit life.

Prior embodiments of the invention contemplate that projection 40 is integrally formed with body 24. A non-integral embodiment of the invention is illustrated in FIG. 5 which discloses a bullet shaped body 60 which defines a cutting face 62 which defines a cutting surface 65 formed of an extremely hard compound, e.g. polycrystalline diamond. As discussed above in reference to previous embodiments, surface 65 may be formed on face 62 via high temperature, high pressure sintering. It is contemplated that body 60 is itself formed of tungsten carbide.

As illustrated in FIG. 5, body 60 defines at its distal end a transverse bore 69. Bore 69 accommodates a traverse element 71 which may be made from tungsten carbide or other hard metal. It is contemplated within the spirit of the invention that Element 71 is held in base 69 by brazing or other conventional technique. Element 71 is adapted to project above the upper edge 73 of body 60 so as to define an exposure height less than the exposure height of the point of contact 66 defined by face 62 and surface 65.

The embodiment illustrated in FIG. 5 is desirable in some aspects since the bullet shape of body 60 enables a stronger interface with surface 65 since the necessity of including a braze joint with a carrier element is eliminated.

It is contemplated that the cutter system of the present invention may be attached to a drill face via a variety of methods. In this connection, the mounting system may be attached via brazing into a steel or matrix bit or press fit into s steel bit. In a preferred embodiment, at least one or two cutters would be placed on each blade to optimize stabilization and wear performance.

Although particular detailed embodiments of the method of the invention have been described therein, it should be understood that the invention is not restricted to the details of the preferred embodiments. Many changes in design, composition, configuration and dimensions are possible without departing from the spirit and scope of the instant invention. Further benefits and advantages of the present invention will become obvious to those skilled in the art in light of the following claims.

What is claimed is:

1. An improved cutting element comprising:

a carrier element and a mounting body, where said carrier element includes a cutting surface, the combination carrier element and mounting body defining a major axis generally perpendicular to the plane defined by the cutting surface;

said mounting body defining a stabilizing projection, where said projection itself defines a leading face and a trailing face;

said mounting body further defining a void area disposed between said carrier element and said stabilizing projection, where said mounting body between said void area and said cutting face defines an attachment wall inclined at an angle θ with respect to said major axis.

2. The cutting element of claim 1 wherein the leading face of said stabilizing projection is rounded.

3. The cutting element of claim 1 wherein the leading face of said stabilizing projection defines a cutting track of substantially the same size as that defined by said cutting surface.

4. The cutting element of claim 1 wherein said cutting surface is comprised of polycrystalline diamond.

5. The cutting element of claim 1 where said carrier element is attached to said mounting body via high temperature braze joint.

6. The cutting element of claim 1 wherein the mounting body is comprised of tungsten carbide.

7. The cutting element of claim 1 wherein angle θ is between 10–30°.

8. The cutting element of claim 1 where the plane defined by the cutting surface describes a back rake angle ϕ with respect to a line drawn normal to a plane defined by the formation, where said angle ϕ is between 10–30°.

9. The cutting element of claim 1 where said cutting surface is formed on said carrier element by sintering.

10. An improved element for attachment on a downhole drill bit for cutting a given formation comprising:

a cutting face and a mounting body, where said cutting face includes a polycrystalline diamond layer, where further said cutting face and said body are attached together via a high temperature braze joint;

said cutting face defining a planar cutting surface; and said mounting body defining a raised stabilizing projection aligned with said cutting face about said axis "A" and defining an intermediate area, where said intermediate area in operation of said drill bit is further removed from said formation than either of said cutting face or said stabilizing projection.

11. The cutting element of claim 10 wherein the stabilizing projection defines a rounded leading edge.

12. The cutting element of claim 10 wherein the mounting body between the intermediate area and the cutting face defines a wall disposed at an angle between 0° and 30° with respect to axis A.

13. The cutting element of claim 10 wherein the stabilizing area defines a cross sectional area substantially similar to that of the cutting face.

14. The cutting element of claim 10 wherein the plane described by the cutting surface is disposed at an angle between 10–30° with respect to the plane described by the formation.

15. A drill bit connectable to a rotary drill string comprising:

a base portion disposed about a longitudinal bit axis for connecting to the downhole end of the drill string;

a side portion disposed about said longitudinal axis;

a face portion disposed about the longitudinal bit axis, which face portion provided which one or more cutting elements comprising:

a cutting face and a mounting body, where said cutting face defines a cutting surface;

said mounting body defining an attachment site to receive the cutting face;

a stabilizing projection formed along said mounting body and defining a leading face and a trailing face;

said mounting body further defining a depressed area disposed between said cutting face and said stabilizing projection; and the mounting body between said depressed area and said cutting face defining an attachment wall disposed at an angle θ with respect to at an axis defined by the cutting element.

16. The drill bit of claim 15 wherein θ is between 10° to 30°.

17. The drill bit of claim 15 wherein the stabilizing projection defines a rounded leading face and a rounded trailing face.

18. The cutting element of claim 15 wherein said cutting surface is comprised of polycrystalline diamond.

19. The cutting element of claim 18 wherein the cutting face is attached to the mounting body via a high temperature braze joint.

20. The cutting element of claim 15 wherein the mounting body is comprised of tungsten carbide.

21. The cutting element of claim 15 wherein said cutting surface is disposed at a back rake angle ϕ as measured between a line normal to the plane described by the formation and the plane described by the cutting surface, where ϕ is between 10–30°.

* * * * *